US006193177B1

(12) United States Patent
Chevalier et al.

(10) Patent No.: US 6,193,177 B1
(45) Date of Patent: Feb. 27, 2001

(54) DEVICE FORM MOVING FORWARD THE SUBSTANCE IN A KNIFE HOG

(75) Inventors: Philippe Chevalier, Boissets; Alain Cordonnier, Lille; Philippe Lagache, Marcq-en-Baroeul; Christophe Obry, Santes, all of (FR)

(73) Assignee: FCB Societe Anonyme, Montreuil (FR)

( * ) Notice: Subject to any disclaimer, the term of this patent is extended or adjusted under 35 U.S.C. 154(b) by 0 days.

(21) Appl. No.: 09/202,470

(22) PCT Filed: Apr. 15, 1997

(86) PCT No.: PCT/FR97/00679

§ 371 Date: Aug. 26, 1999

§ 102(e) Date: Aug. 26, 1999

(87) PCT Pub. No.: WO98/46355

PCT Pub. Date: Oct. 22, 1998

(51) Int. Cl.[7] ..... B02C 4/40
(52) U.S. Cl. ..... 241/57; 241/228
(58) Field of Search ..... 241/228, 57

(56) References Cited

U.S. PATENT DOCUMENTS 1,603,639 * 10/1926 Reed .
2,745,748 * 5/1956 McCashen ..... 241/228
3,596,841 * 8/1971 Perry ..... 241/228
5,205,494 * 4/1993 Durinck et al. ..... 241/228

FOREIGN PATENT DOCUMENTS

548555 * 4/1932 (DE) .
471647 * 11/1914 (FR) .
2679792 * 2/1993 (FR) .

* cited by examiner

*Primary Examiner*—Mark Rosenbaum
(74) *Attorney, Agent, or Firm*—Harrison & Egbert

(57) ABSTRACT

A grinding apparatus for forward feeding material in a drum in which the grinding apparatus has a circular grinding track therein. The drum is driven in rotation at a speed such that material therein is held on the circular grinding track by centrifugal force. A knife is positioned in an upper descending portion of the drum for detaching material from the circular grinding track. A deflecting plate is disposed beneath the knife so as to receive materials detached by the knife and to divert the detached materials toward the output of the drum. The knife is disposed such that the knife has an active face forming an angle of between +15° and −50° with a radial plane extending between a horizontal axis of the drum and an edge of the active face.

5 Claims, 1 Drawing Sheet

DEVICE FORM MOVING FORWARD THE SUBSTANCE IN A KNIFE HOG

TECHNICAL FIELD

The present invention relates to grinders constituted by a drum having a horizontal axis, inside which is provided a circular grinding track and comprising means for driving the drum in rotation at a speed above the critical speed in such a way that the material in the process of being ground is maintained on the track by centrifugal force, a roller placed inside the drum so as to be able to travel over the track and pressed against the latter, and a device for displacing the material from one edge of the track to the other constituted by a knife or blade placed inside the drum, in its upper descending portion, so as to detach the layer of material from the track, and by at least one deflecting plate disposed beneath the knife so as to intercept the material detached by the latter and to deflect it towards the grinder output.

BACKGROUND ART

A grinder of this type is disclosed in French patent No. 91 09788. In this grinder, the active plane of the knife forms an angle of approximately −45° with the radial plane containing the edge of the knife, and the layer of material is, in certain cases, detached from the track in the form of agglomerates. This has drawbacks, particularly when it is desired to dry the material with a hot gas.

The object of the present invention is to ensure the breaking up of the layer of material by the knife and its dispersal, which makes it possible to improve heat exchanges, when the material has to be dried using hot gases, and, if applicable, to facilitate grain size selection, thus permitting selective forward feeding of the material. Another object of the invention is to reduce the wear of the knife and of the deflecting blade.

SUMMARY OF THE INVENTION

The material forward feed device of the present invention is characterised in that the active plane of the knife forms an angle of between −50° and +15° with the radial plane resting upon its edge.

Blowing nozzles supplied with gas under pressure and pointed towards the track are associated with the knife to complete its action. Because of these nozzles it will be possible to avoid contact between the edge of the knife and the track or the layer of material adhering thereto and, consequently, to reduce its wear. Furthermore, the nozzles will enhance the dispersal of the material.

The deflecting plate can be constituted by a flat caisson or box, the upper face of which will be permeable to air and which will be supplied with air or with another gas under pressure. By reducing the friction of the material on the plate, this arrangement will enable its wear to be reduced. Furthermore, the gas jets emitted through the upper face of the plate can be orientated appropriately to effect selective forward feed of the material, as a function of its grain size.

BRIEF DESCRIPTION OF THE DRAWINGS

The characteristics of the invention will be more clearly apparent from a study of the following description which refers to the accompanying drawings which show, by way of a non-limitative example, a form of embodiment of the invention, and wherein.

DETAILED DESCRIPTION OF THE INVENTION

Figure 1:
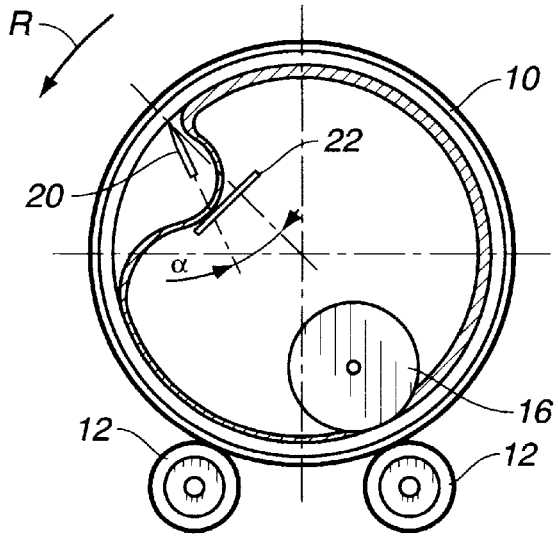
FIG. 1 is a schematic representation, in vertical section, of a grinder comprising the present invention.

The grinder shown in the drawings is formed by a drum 10, having a horizontal axis. The drum 10 is supported by rollers 12 enabling it to rotate about its axis. The drum is driven in rotation by conventional means, not shown, for example by a motor unit and a reducer, the output shaft of which bears a pinion engaged with a toothed wheel fixed to the drum.

The drum is internally clad with wear plates which form an annular grinding path 14.

A roller 16 is mounted inside the drum so as to be able to travel over the track when the drum is driven in rotation. This roller is provided with journals mounted in bearings guided by vertical slideways or by levers and subjected to the action of springs or jacks enabling the roller to be pressed onto the grinding track with a predetermined, adjustable force. This mounting system is conventional, and is not shown in the drawings.

In operation, the drum is driven in rotation, in the direction of arrow R, at a speed such that all the material is centrifuged and pressed against the track.

A device designed to ensure the forward feeding of the material on the track, in a direction parallel to the axis of the drum, is disposed in the upper half of the drum, on the descending portion of the circular trajectory of the materials. This device is of the type described in French patent No. 91.09788. It is constituted by a fixed knife 20, which is disposed parallel to the axis of the drum. The fixed knife 20 has an edge located in the vicinity of the surface of the grinding track. One or more deflecting plates 22 are disposed beneath the knife so as to intercept the flow of materials detached from the track by the latter and to return it to the track. The plate, or each of them, is inclinable about a horizontal axis, parallel to the axis of the drum, and orientatable about a vertical axis, so that it is possible, by varying its inclination and its orientation, to displace the point at which the material returned to the track is dropped, to change the speed of the material at the dropping point and to adjust the speed of forward feed, parallel to the axis of the drum, of the material on the track. The orientation and inclination of the plates are controlled from outside the drum using appropriate conventional means.

Figure 2:
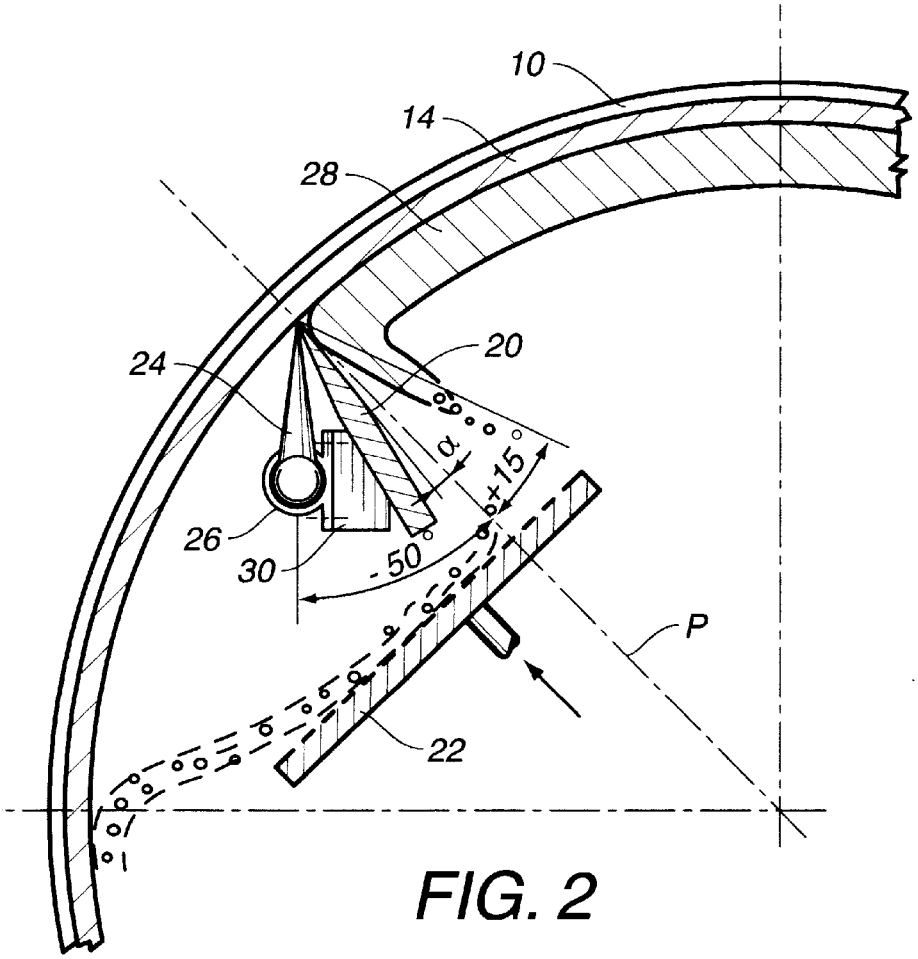
FIG. 2 is a partial view, on a larger scale, of the grinder of FIG. 1.

According to the invention, the active face of knife 20 forms with the plane P, containing the axis of the drum and resting on the edge of the knife, an angle $\alpha$ of between +15° and −50°. The active face of the knife is that against which the material abuts. In FIG. 2, the active face of the knife forms with plane P an angle $\alpha$ in the order of −5°. By convention, angle $\alpha$ is positive when the knife is located upstream of plane P, as viewed in the direction of rotation of the drum, and negative in opposite case.

Nozzles 24 supported by a distribution pipe 26 supplied with compressed air are disposed behind knife 20 so as to emit jets of air directed towards the surface of the track, between the surface of the track and the edge of the knife. These jets of air complete the action of the knife in detaching the layer of material 28 from the track and in breaking it up, and prevent the material from passing beyond the edge of the knife. The knife and the distribution pipe are supported by a beam 30 passing through the drum and the position of which in relation to the drum is adjustable so as to be able to adjust the angle $\alpha$ and the distance between the surface of the track and the edge of the knife. The relative positions of the knife and of the nozzles can also be adjustable. Alternatively, the nozzles can be integrated into the knife.

Plate 22 is constituted by a flat caisson or box, the upper wall of which is permeable to air. For example, this wall can be formed of sintered or woven material, or constituted by a metal sheet pierced with holes, or formed by strips arranged in the fashion of slatted shutters. The plate 22 is supplied with compressed air and the air escaping through its upper face tends to entrain the grains of material dropping onto the plate and remove them from the latter, which reduces friction and, consequently, the wear of the plate. The upper wall of the plate can be designed, in particular when it is constituted by a perforated or slatted shutter type wall, in such a way that the jets of air emitted through the wall have a preferential direction and act in a selective manner upon the grains, according to their size, so as to cause a faster forward feed of the finer grains than of coarser grains. This enhances grinding efficiency.

The upper face of the plate or plates 22 can be planar, as shown, or curved. Other forms of embodiment of the knife, of the nozzles and of the deflecting plates can be provided within the framework of the invention claimed.

The knife, the associated nozzles and the air caisson type plates can be adopted jointly, as in the above example, or independently, as required.

In a grinder comprising a supply chamber upstream of the track and an evacuation chamber placed downstream, devices analogous to the one described above can be used in the supply chamber and/or in the evacuation chamber. Similarly, in a grinder comprising several grinding tracks disposed side by side, or spaced along the drum, the device according to the invention can be used to transfer the materials from one track to the other.

What is claimed is:

1. A grinder apparatus comprising:

a drum means having a horizontal axis, said drum means having a circular grinding track therein, said drum means for being driven in rotation at a speed such that material therein is held against said circular grinding track by centrifugal force;

a knife means positioned at an upper descending portion within said drum means, said knife means for detaching the material from said circular grinding track;

a deflecting plate means disposed beneath said knife means for receiving the detached material from the circular grinding track means and for directing the detached material toward an output of said drum means, said knife means having an active face forming an angle of between +15° and −50° relative to a radial plane extending between said horizontal axis of said drum means and an edge of said active face; and blowing nozzles oriented towards said circular grinding track adjacent said knife means, said blowing nozzles being supplied with pressurized gas.

2. The grinder apparatus of claim 1, said knife means and said blowing nozzles being mounted on a support such that a position of said knife means and said blowing nozzles is adjustable relative to said circular grinding track.

3. The grinder apparatus of claim 1 wherein said blowing nozzles are integrated into said knife means.

4. The grinder apparatus of claim 1, said deflecting plate mans having a gas permeable upper face, said deflecting plate means being supplied with pressurized gas.

5. A grinder apparatus comprising:

a drum means having a horizontal axis, said drum means having a circular grinding track therein, said drum means for being driven in rotation at a speed such that material therein is held against said circular grinding track by centrifugal force;

a knife means positioned at an upper descending portion within said drum means, said knife means for detaching the material from said circular grinding track; and a deflecting plate means disposed beneath said knife means for receiving the detached material from the circular grinding track and for directing the detached material toward an output of said drum means, said knife means having an active face forming an angle of between +15° and −50° relative to a radial plane extending between said horizontal axis of said drum means and an edge of said active face, said deflecting plate means being hollow, said deflecting plate mans having a gas permeable upper face, said deflecting plate means being supplied with pressurized gas.

* * * * *